US009079281B2

(12) United States Patent
Kosiorek

(10) Patent No.: US 9,079,281 B2
(45) Date of Patent: Jul. 14, 2015

(54) COMMON RAIL VALVE SEAT REFURBISHING

(75) Inventor: Roman F. Kosiorek, Greenville, MI (US)

(73) Assignee: North American Fuel Systems Remanufacturing, LLC, Kentwood, MI (US)

( * ) Notice: Subject to any disclaimer, the term of this patent is extended or adjusted under 35 U.S.C. 154(b) by 432 days.

(21) Appl. No.: 13/433,481

(22) Filed: Mar. 29, 2012

(65) Prior Publication Data

US 2013/0260647 A1 Oct. 3, 2013

(51) Int. Cl.

| | |
|---|---|
| ***B24B 9/00*** | (2006.01) |
| ***B24B 1/00*** | (2006.01) |
| ***B24B 15/02*** | (2006.01) |
| ***B24D 7/18*** | (2006.01) |

(52) U.S. Cl.

CPC ... *B24B 1/00* (2013.01); *B24B 9/00* (2013.01); *B24B 15/02* (2013.01); *B24D 7/18* (2013.01)

(58) Field of Classification Search

CPC ..... B24B 1/00; B24B 15/02; B24B 9/00; B24D 7/18

USPC ..... 451/430, 431, 177, 28; 29/888.42, 29/888.44

See application file for complete search history.

(56) References Cited

U.S. PATENT DOCUMENTS

| | | | | | |
|---|---|---|---|---|---|
| 1,753,935 | A | * | 4/1930 | Maisch | 408/83.5 |
| 1,953,284 | A | * | 4/1934 | Willard | 451/430 |
| 1,975,985 | A | * | 10/1934 | Stowell | 451/415 |
| 2,351,134 | A | * | 6/1944 | Koulish | 125/30.01 |
| 2,454,068 | A | * | 11/1948 | Kuhlman | 451/430 |
| 2,748,547 | A | * | 6/1956 | Davies et al. | 451/430 |
| 4,467,566 | A | * | 8/1984 | Ondrus et al. | 451/430 |
| 4,545,706 | A | * | 10/1985 | Hiroyasu et al. | 408/1 BD |
| 4,617,764 | A | * | 10/1986 | Reibakh | 451/5 |
| 4,896,638 | A | * | 1/1990 | Shepley | 29/888.061 |
| 4,901,752 | A | * | 2/1990 | Horvei | 137/315.42 |
| 4,996,799 | A | * | 3/1991 | Pound et al. | 451/430 |
| 5,305,556 | A | * | 4/1994 | Kopp et al. | 451/165 |
| 5,445,478 | A | * | 8/1995 | Ordogh et al. | 408/1 R |
| 5,829,928 | A | * | 11/1998 | Harmand et al. | 408/83.5 |
| 6,173,494 | B1 | * | 1/2001 | Becker | 29/890.122 |
| 6,339,877 | B1 | | 1/2002 | Straub et al. | |
| 6,640,410 | B2 | * | 11/2003 | Harmand et al. | 29/407.08 |
| 6,679,766 | B2 | | 1/2004 | Schulz et al. | |
| 7,991,538 | B2 | | 8/2011 | Olbrich et al. | |
| 8,046,917 | B2 | | 11/2011 | Kosiorek | |
| 2003/0087487 | A1 | * | 5/2003 | Finke et al. | 438/200 |
| 2009/0143000 | A1 | * | 6/2009 | Wimberly | 451/430 |
| 2010/0116910 | A1 | * | 5/2010 | Girlinger et al. | 239/533.3 |

FOREIGN PATENT DOCUMENTS

| | | | | |
|---|---|---|---|---|
| GB | 2284777 | A | * | 6/1995 |

* cited by examiner

*Primary Examiner* — Lee D Wilson
*Assistant Examiner* — Joel Crandall
(74) *Attorney, Agent, or Firm* — Bill C. Panagos; J. Scott Martin; Butzel Long, P.C.

(57) ABSTRACT

A tool, method and apparatus to refurbish a valve seat having a compound geometry, such as a valve seat in a valve body for a common rail injector is disclosed. The tool includes a body with a head portion having substantially the same geometry as the valve seat to be refurbished, the tool further including a radiused portion between two angles of the valve seat to provide a chamfered surface on the valve seat to be refurbished. The method includes lapping the valve seat with the tool in and X, Y and Z axis to refurbish the valve seat in a single operation without substantially altering the geometry of the valve, and the apparatus includes slide moveable in an X and Y axis, and a fixture mounted on a preloaded biased base so movement in the Z axis is controllable.

6 Claims, 8 Drawing Sheets

COMMON RAIL VALVE SEAT REFURBISHING

TECHNICAL FIELD

In a common rail injector, the high pressure valve seat is used to control injector firing. When the magnetic energizer energizes, the armature lifts and a ball lifts from its seat. High pressure fuel (up to 2000 bar) spills out of the control chamber at elevated velocities between the ball and the valve seat. The lift of the ball is only in the order of about 50 microns, and this creates extreme fuel velocities, which make the area prone to cavitation. To address this, manufacturers have provided a small relief angle called a diffuser below the valve seat to help smooth the fluid flow past the ball/valve seat while the injector is firing.

It has been a challenge in remanufacturing the valve seat on a common rail injector to provide for consistent stock removal between the valve seat and the diffuser. Typical approaches had been lapping the valve seat, which only serves to reduce the effective diffuser diameter, which in turns increases the rate of cavitation. Lapping the valve seat and the diffuser separately presents extreme challenges in maintaining the diffuser diameter within acceptable tolerances.

There is a need for a tool, a process and an apparatus to lap the valve seat and maintain the diffuser diameter within acceptable tolerances in refurbishment of common rail fuel injectors.

SUMMARY

In one embodiment, the disclosure relates to a lapping tool to refurbish a ball check valve seat having compound geometric profile. The tool includes a body having a length and a width wherein the length may be greater than the width. The body so defined has a first end and a second end in opposed relation to each other. The first end is insertable into a unit for lapping tool motion in an X axis, a Y axis and a Z axis. The second end terminates in a head portion. The head portion may be equipped with an abrasive surface and has a compound geometric profile substantially the same as the compound geometric profile of said valve seat and also includes a radiused portion at the intersection of the compound geometric profile to create a chamfered surface. The tool is rotated at various speeds to facilitate refurbishing of the valve seat in a single action.

In another embodiment, the disclosure relates to a lapping tool to refurbish a ball check valve seat having a valve seat angle and a diffuser angle. The tool includes a body having a length greater than a width and opposed first and second ends. The first end is configured to be insertable in a lapping unit for motion of the tool in an X axis, a Y axis and a Z axis. The second end is equipped with a head portion having an abrasive surface. The head portion is configured to have a head valve seat angle and a head diffuser angle separated by a radiused portion. The head portion valve seat angle is of substantially the same angle as the valve seat angle, and the head portion diffuser portion angle is of substantially same angle as said valve seat diffuser angle. The head radiused portion forms a chamfered intersection between said valve seat angle and said valve seat diffuser angle to maintain the diameter of the refurbished diffuser.

In another embodiment, the disclosure relates to methods to refurbish a ball check valve having a valve seat portion with a first angle and a diffuser having a second angle, said first angle intersecting said second angle. One such method may include mounting a ball check valve; moving a lapping tool into engagement with the check valve an X axis, a Y axis and a Z axis; the lapping tool having a body with a length greater than a width; and opposed first and second ends; the first end being insertable in a lapping unit for motion of the tool in an X axis, a Y axis and a Z axis, and the second end equipped with a head portion having an abrasive surface. The head portion may have a valve seat angle and a diffuser angle separated by a radiused portion; the head portion valve seat angle of substantially the same angle as the valve seat angle, and said head portion diffuser portion angle of substantially same angle as said valve seat diffuser angle; and said head radiused portion forming a radiused intersection between said valve seat angle and said valve seat diffuser angle; the motion said lap tool in an X axis, a Y axis and a Z axis to remove cavitation from said valve seat and said diffuser portion and create a chamfered portion in at the intersection of said valve seat angle and said diffuser angle in a single operation.

In another embodiment the disclosure related to an apparatus to refurbish a ball check valve in a single operation. The apparatus may be a computer numerically controlled machining center, including a fixture configured to accept a ball check valve. The fixture is mountable in an precision slide machining apparatus for movement of the fixture in an X axis and a Y axis, and the fixture is supported by a preloaded biaser, such as, for example a spring, to control movement of the fixture in a Z axis. The apparatus may also include a rotary power unit suitable to rotate a lapping tool at various speeds. The lapping tool may be equipped with a body having a length greater than a width and opposed first and second ends. The first end is insertable in a lapping unit for motion of the tool in an X axis, a Y axis and a Z axis, and the second end is equipped with a head portion having an abrasive surface. The head portion has a valve seat angle and a diffuser angle separated by a radiused portion. The head portion valve seat angle of substantially the same angle as the valve seat angle, and the head portion diffuser portion angle of substantially same angle as said valve seat diffuser angle. The head portion also includes a radiused portion forming a chamfered intersection between said head portion valve seat angle and said head portion valve seat diffuser angle.

These and other aspects of the disclosure will be apparent upon a reading of the specification and consideration of the drawings and claims.

DETAILED DESCRIPTION

Figure 1:
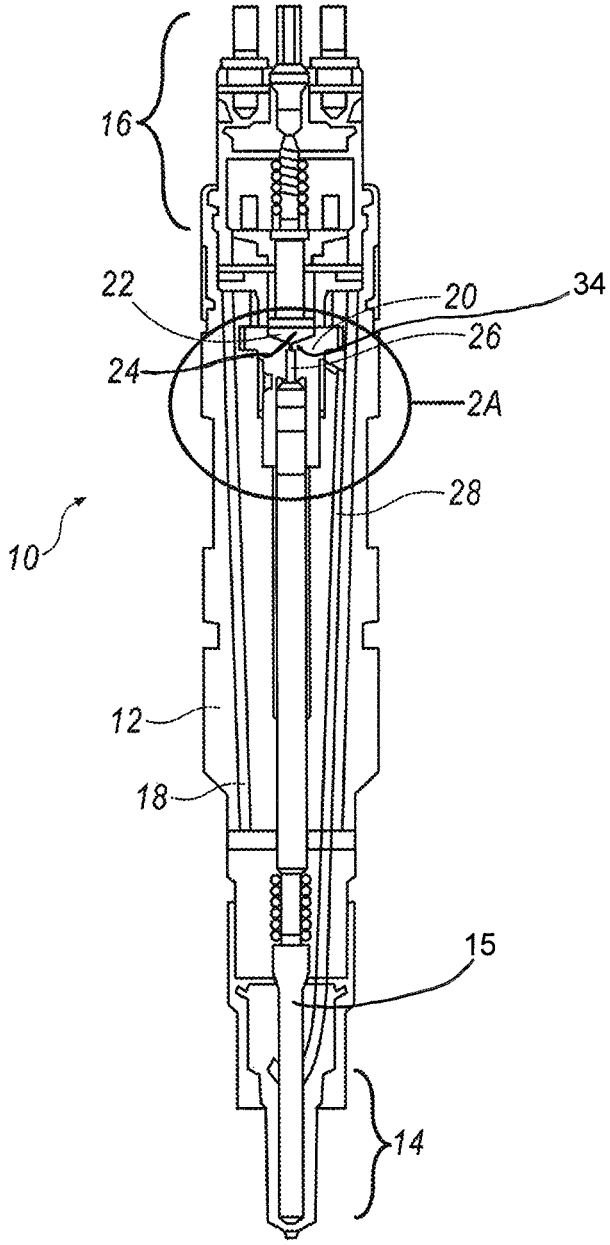
FIG. 1 is a schematic representation of a common rail injector with a ball check valve.

Turning now to the drawings wherein like numbers refer to like structures, FIG. 1 is a representation of a common rail injector 10. While there are many parts and assemblies that comprise the common rail injector, the description will be only to those portions of the common rail fuel injector that are relevant to the inventive concepts of the present application, inasmuch as common rail injectors are well known to those skilled in the art and need not be described in great detail here.

The common rail 10 has a body portion 12 upon which is situated a nozzle portion 14 at one end thereof, and a magnetic energizer 16 at the opposite end. The energizer is electronically connected to an Electronic Control Unit (ECU) and energized as per fueling instructions held in memory of the ECU to permit fuel to pass through the injector and out of the nozzle. In this regard, fuel is introduced under pressure through intake fuel passage 18, where it encounters ball check valve 30 in valve body 20. The ball check valve body has a valve seat surface 22, and a bearing 24. The bearing sits on a bearing seat and obstructs diffuser passage 34. The valve body is composed at least partially of a magnetic material such that when the magnetic energizer is energized, it attracts the valve out of engagement of its seat, and pressurized fuel displaces the bearing, and fuel passes to the high pressure fuel passage 28, lifts the needle 15 in the nozzle 14, and causes fuel to be injected into the engine through apertures (not shown).

Figure 2A:
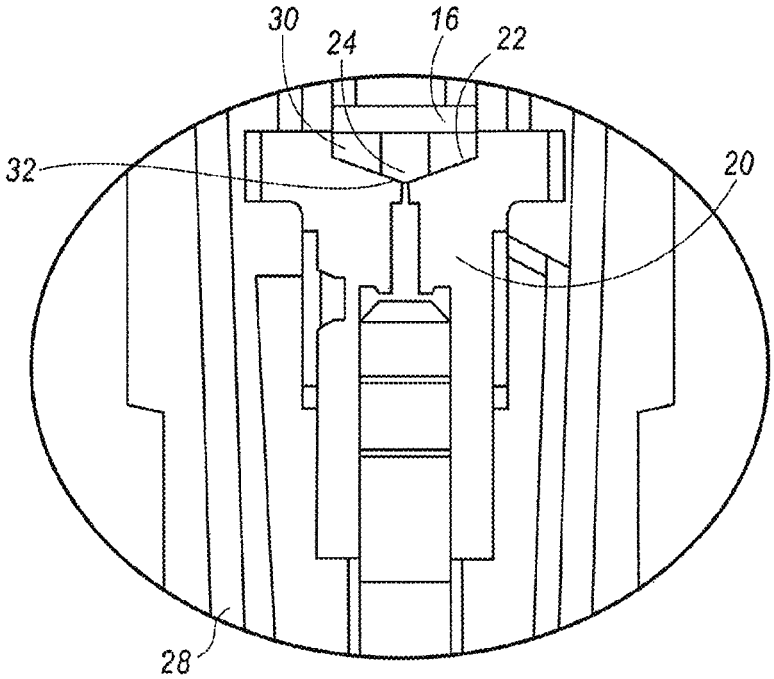
FIG. 2 A is a detailed view of the ball check valve in the common rail injector of FIG. 1.
FIG. 2B is a cut way side view of the ball check valve of FIG. 2A, showing its construction.
FIG. 2C is a detailed view of a section of the ball check valve of FIG. 2A, showing the seat valve.
FIG. 2D is a detailed view of a section of the ball check valve of FIG. 2B showing the diffuser, diffuser distance and diffuser angle.

Turning now to FIG. 2A, there is shown a detail of the valve seat body 20 briefly described in reference to FIG. 1. With greater reference to valve seat body 20, magnetic energizer 16 is in close proximity to valve 30. The valve body has a compound geometry, with a first surface being a valve seat at a first angle. The valve 30 sits atop a bearing 24, that is seated atop a diffuser passage, and has a second angle surface.

Figure 2B:
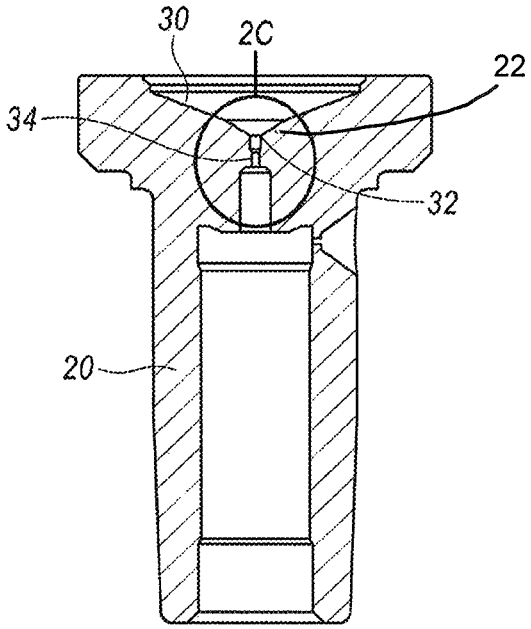

FIG. 2B is a cutaway side view of the valve body of FIG. 2A, showing its construction. Specifically, the valve body 30 sits in a valve seat 22, which has a compound geometric profile of a first inclined surface at a first angle and a second incline surface at a second angle. A bearing 32 is provided in a diffuser passage. When the valve body is attracted by the magnetic energizer, highly pressurized fuel travels into the valve body along the valve seat and displaces the bearing to permit the flow of high pressure fuel into the high pressure fuel passage 34. It should be understood that the bearing is displaced only a slight amount, on the order of about 50 microns, and the fuel is under such high pressure that, as the fuel travels along the valve seat and diffuser passage, cavitation occurs along those surfaces such that accuracy of the injection event is eventually compromised and refurbishing of the valve seat body is necessary to restore the common rail fuel injector to operating specification.

Figure 2C:
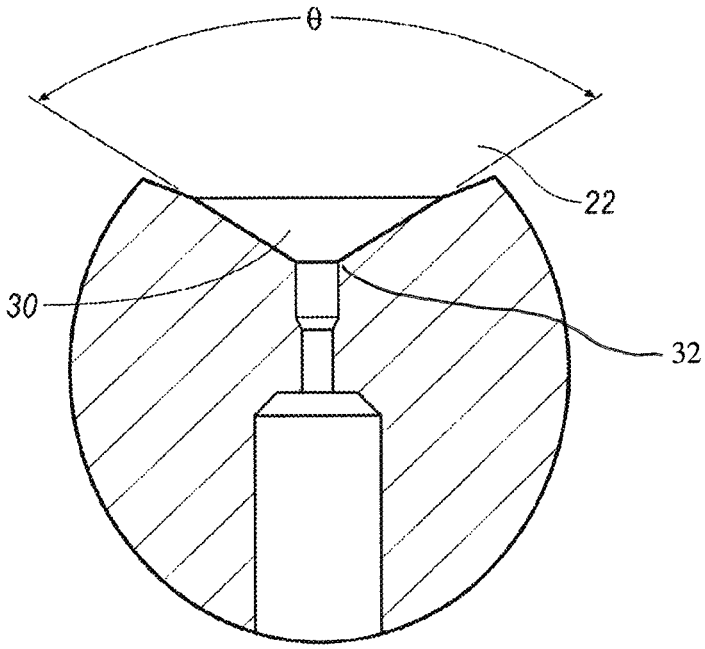
Figure 2D:
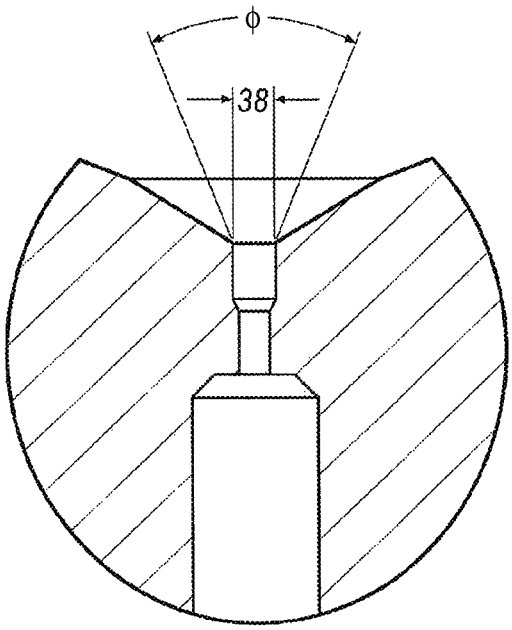

Turning now to FIGS. 2C and 2D, there is shown a detail from FIG. 2B of the valve seat. Specifically, valve seat 22 has a surface with an angle Θ, at a first angle, and contiguous thereof is diffuser angle Φ of a second angle. The diffuser angle surrounds and intersects the diffuser passage 38 to define the ball or bearing seat 32. It is the intersection of the diffuser angle and the ball seat that suffers most from cavitation as the fuel passes through the diffuser passage into the high pressure passage of the common rail injector. It is understood that the sharp contiguous angle intersection between the diffuser angle and the seat angle cause especially high pressure flow that contribute to cavitation.

Figure 3A:
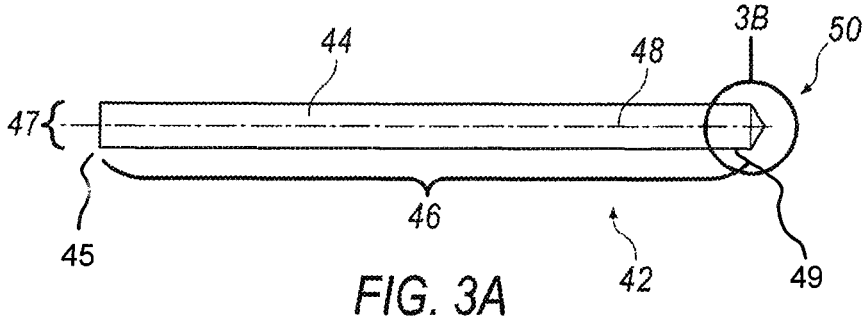
FIG. 3A is a side view of one embodiment of a lapping tool according to the disclosure.
Figure 3B:
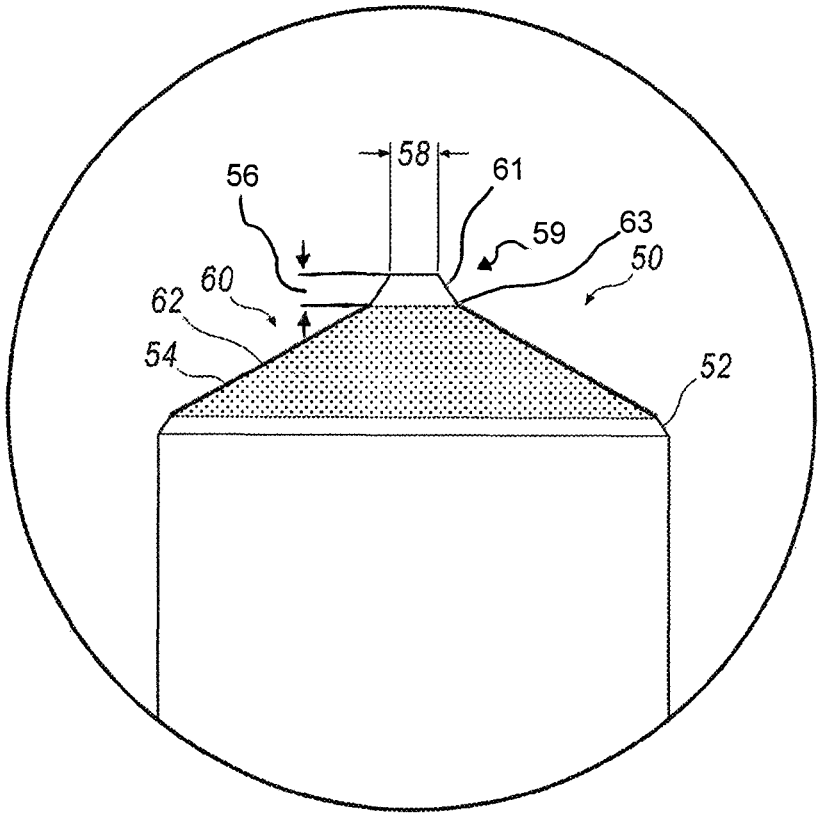
FIG. 3B is a detailed view of the head portion of the lapping tool of FIG. 3A showing its configuration.

FIG. 3B is a detail view of the head portion 50 as seen in FIG. 3A. the head has a tapered portion 52 and an angled work portion 54, extending at a first angle, may be conical, parabolic, semi-spherical, or any other shape desired to refurbish the valve seat surface of the valve body. The work surface 60 is equipped with abrasive material 62, to remove material from the valve seat of the valve body during a lapping motion. The abrasive may be at least one of diamond, cubic boron or silicon carbide, or any other suitable abrasive, and has a grit sufficient to refurbish the valve seat portion of the valve body. In one embodiment, the grit may be on the order of 30 microns. Concentric on the head at its distal end 59 is end diameter portion 58, which extends a sufficient distance 56 to machine the diffuser, and the end diameter 58 is selected to be the same diameter as the diffuser intersection. The end diameter has a work surface 61 that extends in a second angle. The first angle portion of the head work surface is substantially the same angle as the first angle portion of the valve seat, and the second angle portion is substantially the same as the second angle surface of the diffuser. It is important to note that the intersection 63 between the surface 60 and the end diameter 58 is slightly radiused. Accordingly, it can be readily understood that the first angle portion and the second angle portion of the head do not intersect each other, but rather each one intersects the radiused portion 63.

The abrasives may be deposited on the head portion by mixing the abrasive with a plating material, such as nickel, and overlaying the head portion. This plating will also form the radiused portion 63. The radiused portion can also be formed by forming it when the head is formed, and then overlaying it with the abrasive, or in any other way that may be apparent to those skilled in the art.

Figure 4:
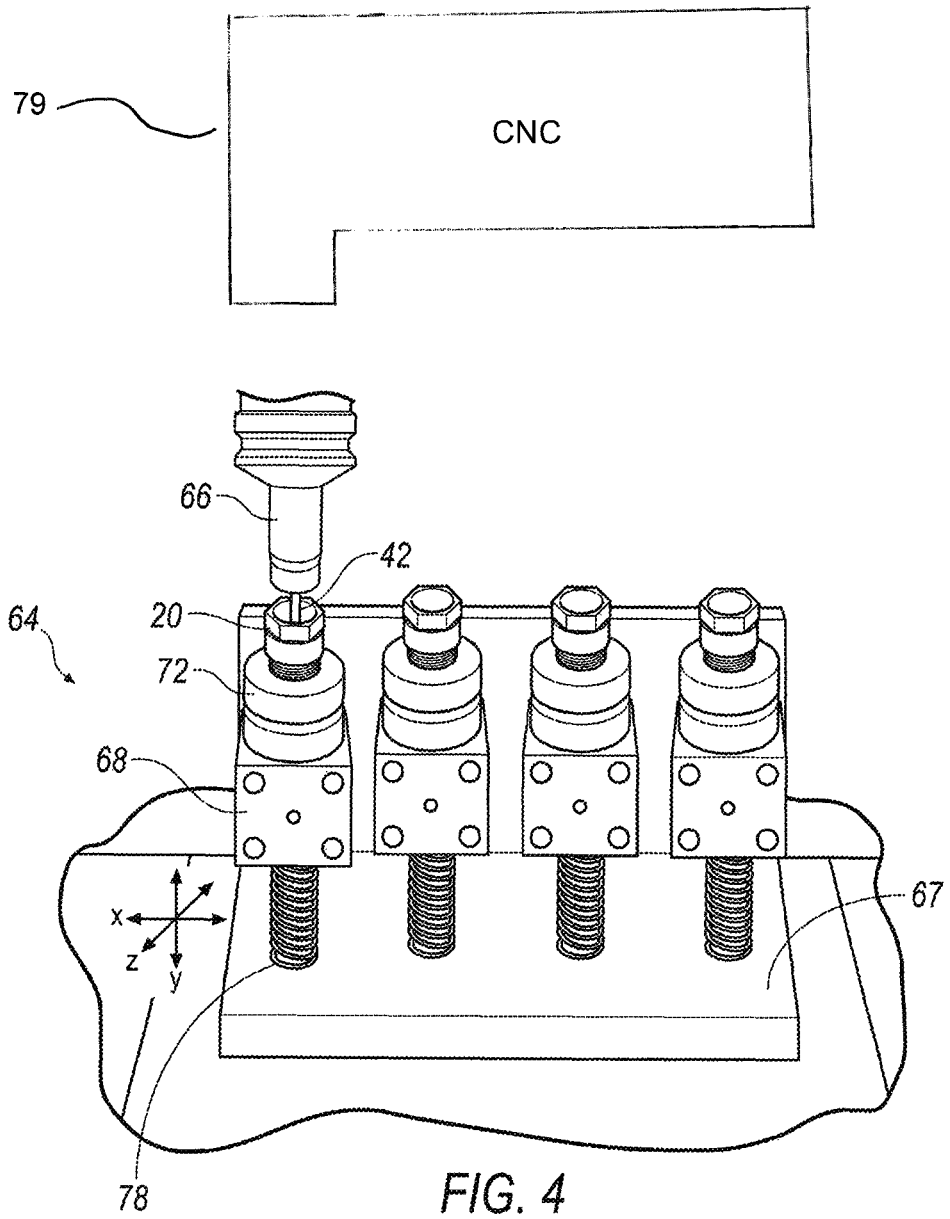
FIG. 4 is a sectional representation of one apparatus according to the disclosure.

FIG. 4 is a schematic representation of an apparatus 64 to refurbish valve seats according to one aspect of this disclosure. Specifically, the lapping tool 42 is fixed or inserted at its first end into rotary power unit 66 for variable speed rotation of the lapping tool. A floating assembly or collet or other suitable fixture 68 into which the valve seat body 20 is held is mounted in fixture 72, which is floatably mounted on a preloaded biaser 78, such as a coil spring, leaf springs, resilient material, a hydraulic or pneumatic cylinder arrangement, or any other arrangement is provided to govern the movement of the collet mounting assembly in the Z axis direction is provided, which in turn is mounted on a slide 67 for movement of the collet and fixture assembly in the X axis and the Y axis. When it is desired to refurbish a valve seat having a compound geometric profile (as described above) the valve seat body is mounted in the collet which is then placed in the fixture 72. The lapping tool may be inserted in to rotary power unit 66 for rotary motion at various speed to provide lapping of the valve seat in a single operation. The rotary unit is lowered until the lapping tool contacts the valve seat surface. The rotary tool is rotated at a relatively high speed for stock removal of the valve seat body for a time sufficient to remove sufficient stock to remove traces of cavitation, and then at a low speed to improve valve seat roundness. Because the lapping tool head includes the radiused portion that finishes the diffuser diameter, the valve seat and the diffuser may be refurbished in a single action. The preloaded biaser prevents over machining in the Z axis, as it is preloaded and will only permit the correct force be applied in the Z axis, as it will bias away from the lapping tool if the tool is plunged too deeply into the valve seat body. The slide is adapted to provide movement of the fixture and collet in the X axis and the Y axis, to allow for lapping of the valve seat to ensure complete removal of stock that may have been affected by cavitation. Generally, the valve seat is subjected to stock removal at tool rotary speeds up to about 2000 RPM until cavitation is removed, and then subjected to valve seat rounding at tool rotary speed of up to about 150 RPM. All machining aspects described above, such as the lowering of the rotary unit to contact the valve seat, activation of the tool for lapping, and adjustment of tool speed, may be controlled by a Computer Numerically Controlled (CNC) machine center 79.

The lapping tool, apparatus and process create a refurbished valve seat body that has a chamfered undercut at the ball seat diffuser of the valve body. The chamfered undercut portion is created by the tool head portion at the area where the valve seat surface portion of the tool head radiuses into the diffuser of the head tool portion. The creation of the chamfered portion reduces fuel flow forces and reduces cavitation due to fuel flow during injector use. In addition, the diffuser diameter is not changed because of the chamfer portion, and the injector can be restored to specification and remain in service for extended periods between refurbishment.

Table 1 shows that the refurbished injectors were tested for four points according to Original Equipment Manufacturer (OEM) specifications. The table contains data that is illustrative, but not limiting, of the concepts in this disclosure. Table 1 shows several test examples of valve seat bodies refurbished with one embodiment of the described lapping tool in one embodiment of the apparatus as described above.

TABLE 1

| Sample | Type | Part Type | Model | Date | Time | Part No. | PASS | Cycle Time | 2VolumeHE Emissions | 2SpillFlow | 2RailPress |
|---|---|---|---|---|---|---|---|---|---|---|---|
| | | | | | | After 512 Hours | | | | | |
| 1 | Product | Injector | 1B | May 4, 2010 | 13:16 | A 647 070 | TRUE | 265 | 19.2418 | 12 | 807 |
| | Product | Injector | 1B | Aug. 11, 2010 | 9:34 | A 647 070 | TRUE | 263 | 19.4377 | 9 | 800 |
| | | | | | | | | | 0.1959 | −3 | −7 |
| 2 | Product | Injector | 1B | May 4, 2010 | 12:48 | A 647 070 | TRUE | 263 | 19.079 | 18 | 807 |
| | Product | Injector | 1B | Aug. 11, 2010 | 9:28 | A 647 070 | FALSE | 262 | 19.1645 | 8.625 | 797 |
| | | | | | | | | | 0.0856 | −9.375 | −10 |
| 3 | Product | Injector | 1B | May 4, 2010 | 13:11 | A 647 070 | TRUE | 263 | 19.8474 | 11.25 | 793 |
| | Product | Injector | 1B | Aug. 11, 2010 | 9:50 | A 647 070 | FALSE | 263 | 21.0375 | 10.125 | 795 |
| | | | | | | | | | 1.1901 | −1.125 | 2 |
| 4 | Product | Injector | 1B | May 4, 2010 | 12:59 | A 647 070 | TRUE | 263 | 19.8593 | 9.75 | 804 |
| | Product | Injector | 1B | Aug. 11, 2010 | 9:44 | A 647 070 | FALSE | 262 | 20.7 | 8.625 | 794 |
| | | | | | | | | | 0.8407 | −1.125 | −10 |
| 5 | Product | Injector | 1B | May 4, 2010 | 13:27 | A 647 070 | TRUE | 263 | 18.3416 | 12 | 795 |
| | Product | Injector | 1B | Aug. 11, 2010 | 9:39 | A 647 070 | TRUE | 263 | 18.5956 | 7.5 | 800 |
| | | | | | | | | | 0.254 | −4.5 | 4 |
| | | | | | | | | AVG | 0.51326 | −3.825 | |
| | | | | | | | Field Tolerance (+/−) | | 1.8 | | |

| Sample | Type | Part Type | Model | Date | Time | Part No. | PASS | Cycle Time | 3VolumeHE Pilot | 3SpillFlow | 3RailPress |
|---|---|---|---|---|---|---|---|---|---|---|---|
| | | | | | | After 512 Hours | | | | | |
| 1 | Product | Injector | 1B | May 4, 2010 | 13:16 | A 647 070 | TRUE | 265 | 0.8754 | 8.25 | 796 |
| | Product | Injector | 1B | Aug. 11, 2010 | 9:34 | A 647 070 | TRUE | 263 | 0.9944 | 6 | 792 |
| | | | | | | | | | 0.119 | −2.25 | −4 |
| 2 | Product | Injector | 1B | May 4, 2010 | 12:48 | A 647 070 | TRUE | 263 | 1.2697 | 15.75 | 795 |
| | Product | Injector | 1B | Aug. 11, 2010 | 9:28 | A 647 070 | FALSE | 262 | 1.8517 | 7.125 | 804 |
| | | | | | | | | | 0.582 | 8.625 | 9 |
| 3 | Product | Injector | 1B | May 4, 2010 | 13:11 | A 647 070 | TRUE | 263 | 1.2374 | 7.5 | 800 |
| | Product | Injector | 1B | Aug. 11, 2010 | 9:50 | A 647 070 | FALSE | 263 | 1.9547 | 8.25 | 802 |
| | | | | | | | | | 0.7173 | 0.75 | 2 |
| 4 | Product | Injector | 1B | May 4, 2010 | 12:59 | A 647 070 | TRUE | 263 | 1.4629 | 7.5 | 797 |
| | Product | Injector | 1B | Aug. 11, 2010 | 9:44 | A 647 070 | FALSE | 262 | 2.3531 | 5.625 | 798 |
| | | | | | | | | | 0.8902 | −1.875 | 1 |
| 5 | Product | Injector | 1B | May 4, 2010 | 13:27 | A 647 070 | TRUE | 263 | 1.0997 | 9.75 | 796 |
| | Product | Injector | 1B | Aug. 11, 2010 | 9:39 | A 647 070 | TRUE | 263 | 1.3048 | 6 | 802 |
| | | | | | | | | | 0.2051 | −3.75 | 6 |
| | | | | | | | | AVG | 0.50272 | 3.15 | |
| | | | | | | | Field Tolerance (+/−) | | 1 | | |

| Sample | Type | Part Type | Model | Date | Time | Part No. | PASS | Cycle Time | 4VolumeH Idle | 4SpillFlow | 4RailPress |
|---|---|---|---|---|---|---|---|---|---|---|---|
| | | | | | | After 512 Hours | | | | | |
| 1 | Product | Injector | 1B | May 4, 2010 | 13:16 | A 647 070 | TRUE | 265 | 4.5918 | 4.8 | 252 |
| | Product | Injector | 1B | Aug. 11, 2010 | 9:34 | A 647 070 | TRUE | 263 | 5.45 | 3.375 | 249 |
| | | | | | | | | | 0.8582 | −1.425 | −3 |
| 2 | Product | Injector | 1B | May 4, 2010 | 12:48 | A 647 070 | TRUE | 263 | 5.1475 | 5.25 | 251 |
| | Product | Injector | 1B | Aug. 11, 2010 | 9:28 | A 647 070 | FALSE | 262 | 5.7999 | 4.5 | 251 |
| | | | | | | | | | 0.6524 | −0.75 | 0 |
| 3 | Product | Injector | 1B | May 4, 2010 | 13:11 | A 647 070 | TRUE | 263 | 5.47 | 3.9375 | 251 |
| | Product | Injector | 1B | Aug. 11, 2010 | 9:50 | A 647 070 | FALSE | 263 | 5.9774 | 3.9375 | 250 |
| | | | | | | | | | 0.5074 | 0 | −1 |
| 4 | Product | Injector | 1B | May 4, 2010 | 12:59 | A 647 070 | TRUE | 263 | 5.7541 | 4.6875 | 253 |
| | Product | Injector | 1B | Aug. 11, 2010 | 9:44 | A 647 070 | FALSE | 262 | 6.3754 | 4.5 | 250 |
| | | | | | | | | | 0.6213 | −0.1875 | −3 |

TABLE 1-continued

| | | | | | | | | | | | |
|---|---|---|---|---|---|---|---|---|---|---|---|
| 5 | Product | Injector | 1B | May 4, 2010 | 13:27 | A 647 070 | TRUE | 263 | 4.4084 | 4.5 | 248 |
| | Product | Injector | 1B | Aug. 11, 2010 | 9:39 | A 647 070 | TRUE | 263 | 5.2133 | 3.75 | 247 |
| | | | | | | | | | 0.8049 | −0.75 | −1 |
| | | | | | | | | AVG | 0.68884 | −0.6225 | |
| | | | | | | | Field Tolerance (+/−) | | 1.3 | | |

| Sample | Type | Part Type | Model | Date | Time | Part No. | PASS | Cycle Time | 5VolumeHE Full Load | 5SpillFlow Spill Flow | 5RailPressure |
|---|---|---|---|---|---|---|---|---|---|---|---|
| | | | | | | After 512 Hours | | | | | |
| 1 | Product | Injector | 1B | May 4, 2010 | 13:16 | A 647 070 | TRUE | 265 | 57.5556 | 31.75 | 1594 |
| | Product | Injector | 1B | Aug. 11, 2010 | 9:34 | A 647 070 | TRUE | 263 | 58.2463 | 26.125 | 1599 |
| | | | | | | | | | 0.6907 | −5.625 | 5 |
| 2 | Product | Injector | 1B | May 4, 2010 | 12:48 | A 647 070 | TRUE | 263 | 57.2882 | 46 | 1593 |
| | Product | Injector | 1B | Aug. 11, 2010 | 9:28 | A 647 070 | FALSE | 262 | 57.506 | 31 | 1598 |
| | | | | | | | | | 0.2578 | −15 | 5 |
| 3 | Product | Injector | 1B | May 4, 2010 | 13:11 | A 647 070 | TRUE | 263 | 57.0978 | 38.625 | 1592 |
| | Product | Injector | 1B | Aug. 11, 2010 | 9:50 | A 647 070 | FALSE | 263 | 57.7607 | 36.875 | 1598 |
| | | | | | | | | | 0.06629 | −1.75 | 6 |
| 4 | Product | Injector | 1B | May 4, 2010 | 12:59 | A 647 070 | TRUE | 263 | 58.5119 | 32.25 | 1596 |
| | Product | Injector | 1B | Aug. 11, 2010 | 9:44 | A 647 070 | FALSE | 262 | 59.3291 | 29.75 | 1600 |
| | | | | | | | | | 0.8172 | −2.5 | 4 |
| 5 | Product | Injector | 1B | May 4, 2010 | 13:27 | A 647 070 | TRUE | 263 | 57.2871 | 36.5 | 1593 |
| | Product | Injector | 1B | Aug. 11, 2010 | 9:39 | A 647 070 | TRUE | 263 | 58.0573 | 28.625 | 1595 |
| | | | | | | | | | 0.7702 | −7.875 | 2 |
| | | | | | | | | AVG | 0.063176 | −6.55 | |
| | | | | | | | Field Tolerance (+/−) | | 2.5 | 61 Max | |

Figure 5:
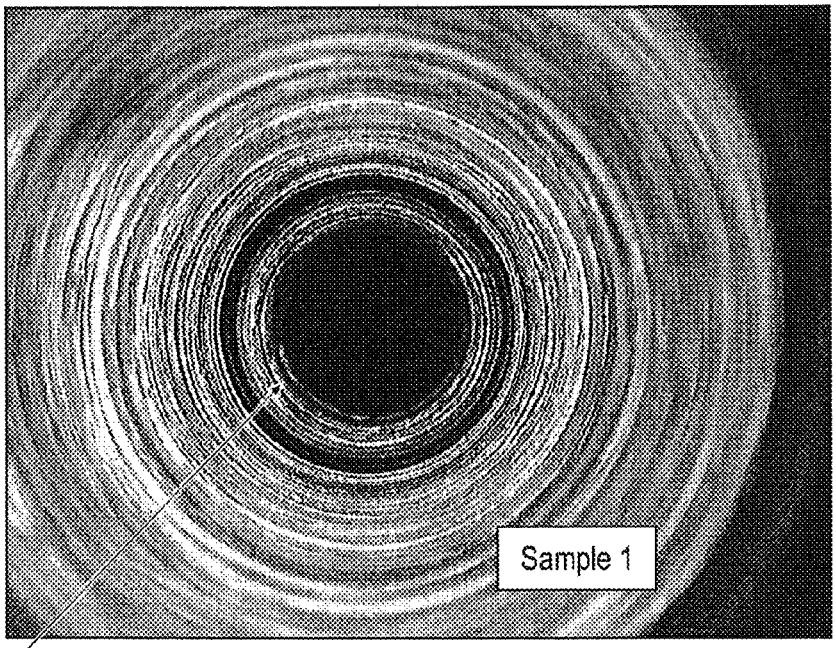
FIGS. 5 through 9 are photomicrographs showing the machined valve seat and diffuser surfaces after various test times to simulate actual use wear.

Specifically, FIG. 5 is a photomicrograph of sample 1, machined and tested as set forth in Table 1. FIG. 5 shows light cavitation at the chamfer (radiused portion)/seat intersection. There was no progression of cavitation into the ball sealing area 57. There is also exhibited a very consistent wear pattern with the core material. The ball sealing area shows normal wear after more than 512 hours of testing.

Figure 6:
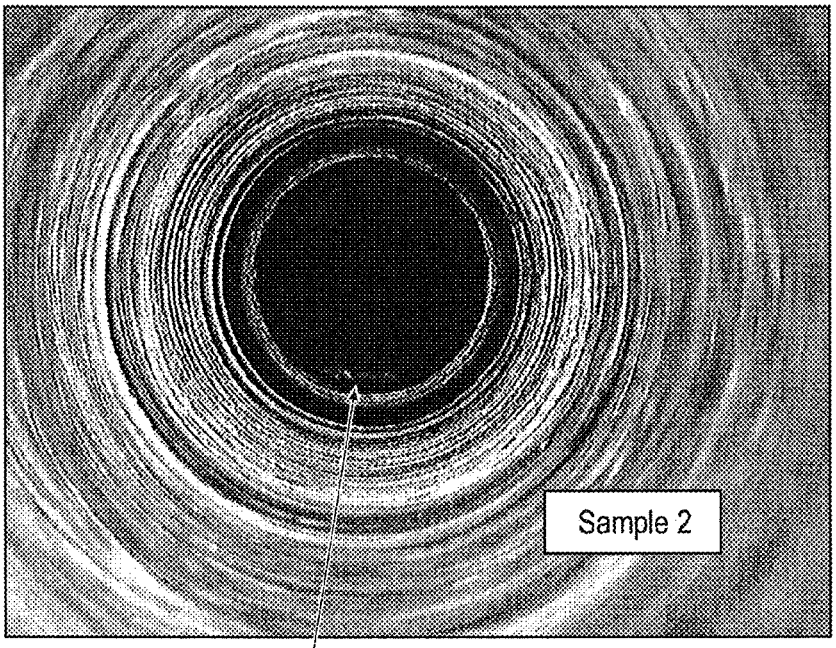

FIG. 6 is a photomicrograph of sample 2, machined and tested as test forth in Table 1. The figure shows heavier cavitation at the chamfer/seat intersection. However, there is no progression of cavitation into the ball sealing area 57, and the core material shows very consistent wear pattern. In addition the ball sealing area 57 shows normal wear, after being machined and tested as set forth in Table 1.

Figure 7:
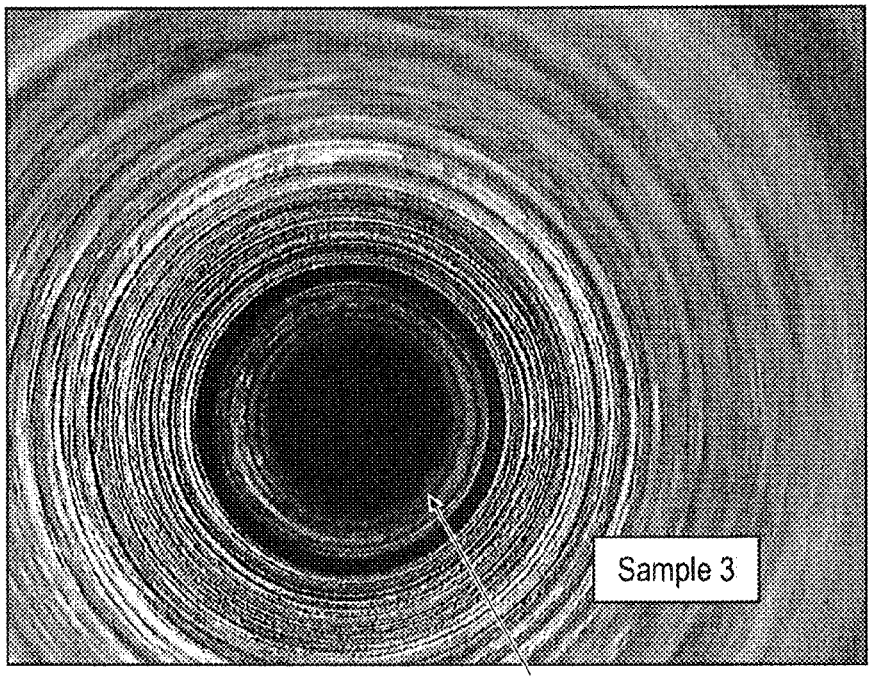

FIG. 7 is a photomicrograph of Sample 3, machined and tested as set forth in Table 1. It can be seen that light cavitation occurred at the chamfer/seat intersection, with no progression into the ball sealing area. The core material also showed very consistent wear pattern, and the ball seating area 57 shows normal wear, after machining and testing as set forth in Table 1.

Figure 8:
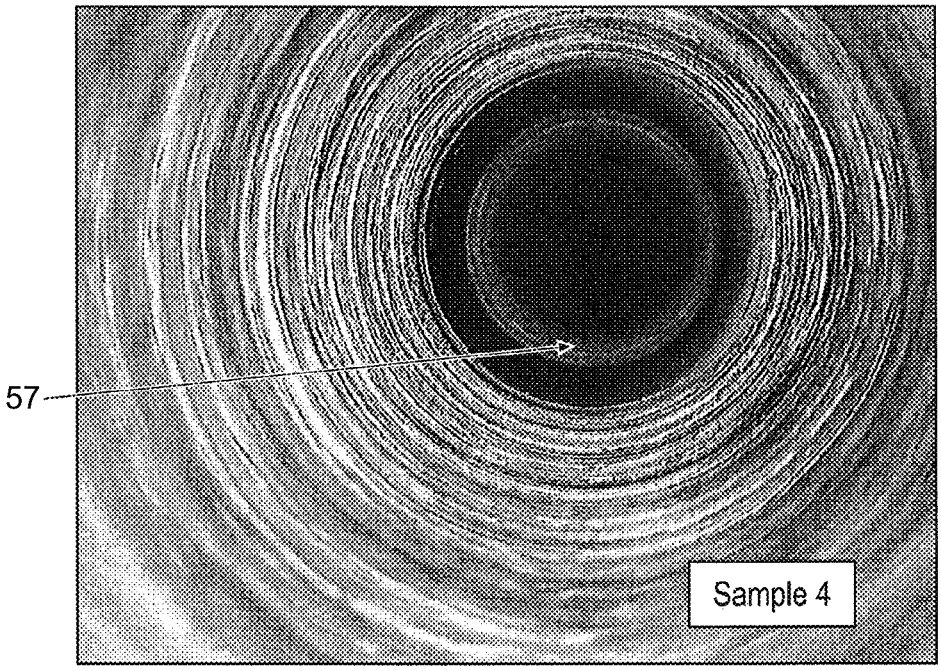

FIG. 8 is a photomicrograph of sample 4, machined and tested as set forth in Table 1. Again, there is no progression of cavitation into the ball sealing area 57, and the core material shows very consistent wear pattern. The ball sealing area shows higher than average wear, but that wear is still consistent with the core material.

Figure 9:
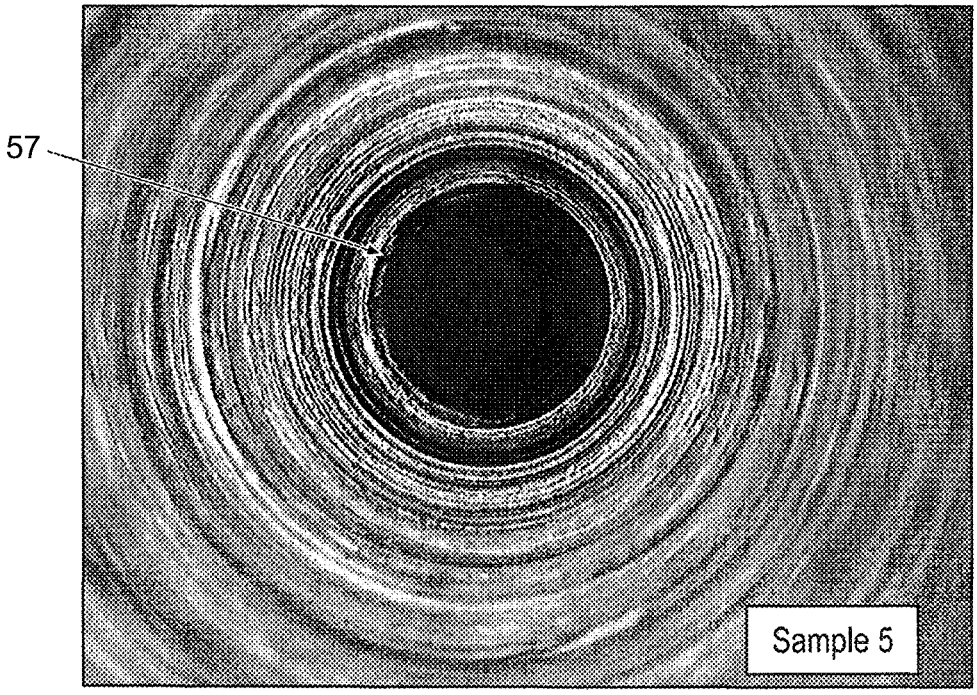

FIG. 9 is a photomicrograph of sample 5, machined and tested as set forth in Table 1. The sample shows a light cavitation at the chamfer/seat intersection, with no progression of cavitation into the ball sealing area. The core material shows a very consistent wear patter and the ball sealing area 57 shows normal wear.

Many modifications and variations of the invention as described are possible in light of the above teachings. In addition, the words used in the specification are of description, not limitation. Within the scope of the appended claims, the invention may be practiced other than as specifically described.

What is claimed as new and desired to be protected by Letters Patent of the United States is:

1. A method to refurbish a ball check valve having a valve seat portion with a first angle and a diffuser having a second angle, said first angle intersecting said second angle; the method comprising:

mounting a ball check valve;

moving a lapping tool into engagement with said check valve in an X axis, a Y axis and a Z axis;

said tool having a body with a length greater than a width;

said body having opposed first and second ends;

said first end insertable in a lapping unit for motion of the tool in an X axis, a Y axis and a Z axis, said second end equipped with a head portion having an abrasive surface;

said head portion having a valve seat angle and a diffuser angle separated by a radiused portion;

said head portion valve seat angle of substantially the same angle as the valve seat angle, and said head portion diffuser portion angle of substantially same angle as said valve seat diffuser angle;

said head radiused portion forming a chamfered intersection between said valve seat angle and said valve seat diffuser angle; and the motion said lap tool in an X axis, a Y axis and a Z axis to remove cavitation from said valve seat and said diffuser portion and create a chamfered portion at the intersection of said valve seat angle and said diffuser angle in a single operation.

2. The method of claim 1, wherein moving said lapping tool includes moving said lapping tool at a first rotation speed for removal of stock material and moving said lapping tool at a second rotation speed lower than said first speed to refurbish said seat surface.

3. The method of claim 1, wherein said abrasive surface includes at least one of diamond, cubic boron, or silicon carbide abrasive having a grit in the range of about 30 microns.

4. The method of claim 1, wherein said compound geometric profile of said valve seat includes a first portion with first geometric profile extending a first distance and a second portion having a second geometric profile different than said first portion extending a second distance.

5. The method of claim 1, wherein said compound geometric profile of said head portion includes a first portion with a first geometric profile extending along a first distance, and a second portion having a second geometric profile extending along a second distance, said first and second portions separated by and contiguous with a radiused third portion.

6. The method of claim 1, wherein said head is nickel plated with said abrasive grit impregnated in said plated layer.

* * * * *